US006858982B2

(12) United States Patent
Yamada et al.

(10) Patent No.: US 6,858,982 B2
(45) Date of Patent: Feb. 22, 2005

(54) IMAGE DISPLAY APPARATUS AND METHOD OF MANUFACTURING THE SAME

(75) Inventors: Akiyoshi Yamada, Fukaya (JP); Kazuyuki Seino, Fukaya (JP); Masahiro Yokota, Fukaya (JP); Takashi Nishimura, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/875,401

(22) Filed: Jun. 25, 2004

(65) Prior Publication Data

US 2004/0232824 A1 Nov. 25, 2004

Related U.S. Application Data

(63) Continuation of application No. PCT/JP02/13527, filed on Dec. 25, 2002.

(30) Foreign Application Priority Data

Dec. 27, 2001 (JP) ..... 2001-398387

(51) Int. Cl.[7] ..... H01J 63/04
(52) U.S. Cl. ..... 313/496; 313/495
(58) Field of Search ..... 313/493, 495, 313/496, 634

(56) References Cited

U.S. PATENT DOCUMENTS 5,692,086 A 11/1997 Beranek et al.
6,049,167 A * 4/2000 Onitsuka et al. ..... 313/512

FOREIGN PATENT DOCUMENTS

| | | |
|---|---|---|
| JP | 57-156391 | 9/1982 |
| JP | 58-87165 | 5/1983 |
| JP | 4-277406 | 10/1992 |
| JP | 9-92184 | 4/1997 |
| JP | 2000-226233 | 8/2000 |
| WO | WO 01/54161 | 7/2001 |

* cited by examiner

*Primary Examiner*—Vip Patel
(74) *Attorney, Agent, or Firm*—Oblon, Spivak, McClelland, Maier & Neustadt, P.C.

(57) ABSTRACT

A vacuum envelope of an image display apparatus has a rear substrate and a front substrate, which are opposed to each other, and a plurality of electron emitting elements are located in the vacuum envelope. The respective peripheral portions of the front substrate and the rear substrate are sealed together with a sealing layer between them. A diffusion layer that contains a component of the sealing layer is formed on the substrate side of an interface between the sealing layer and the front substrate and/or the rear substrate.

14 Claims, 8 Drawing Sheets

EDX analysis result chart <turning point : P1>

EDX analysis result chart <turning point : P2>

EDX analysis result chart <turning point : P4>

EDX analysis result chart <turning point : P5>

IMAGE DISPLAY APPARATUS AND METHOD OF MANUFACTURING THE SAME

CROSS-REFERENCE TO RELATED APPLICATIONS

This is a Continuation Application of PCT Application No. PCT/JP02/13527, filed Dec. 25, 2002, which was not published under PCT Article 21(2) in English.

This application is based upon and claims the benefit of priority from prior Japanese Patent Application No. 2001-398387, filed Dec. 27, 2001, the entire contents of which are incorporated herein by reference.

BACKGROUND OF THE INVENTION

1. Field of the Invention

This invention relates to an image display apparatus, provided with an envelope having two substrates opposed to each other and a plurality of image display elements arranged inside the envelope, and a method of manufacturing the same.

2. Description of the Related Art

Recently, various flat display apparatuses have been developed as a next generation of lightweight, thin image display apparatuses to replace cathode-ray tubes (hereinafter referred to as CRT). These flat display apparatuses include a liquid crystal display (hereinafter referred to as LCD), plasma display panel (hereinafter referred to as PDP), field emission display (hereinafter referred to as FED), surface-conduction electron emitter display (hereinafter referred to as SED), etc. In the LCD, the intensity of light is controlled by utilizing the orientation of liquid crystals. In the PDP, phosphors are caused to glow by means of ultraviolet rays that are produced by plasma discharge. In the FED, phosphors are caused to glow by means of electron beams that are emitted from field-emission electron emitting elements. In the SED, phosphors are caused to glow by means of electron beams that are emitted from surface-conduction electron emitting elements.

In general, the FED or SED, for example, has a front substrate and a rear substrate that are opposed to each other with a given gap between them. These substrates have their respective peripheral portions joined together by means of a sidewall in the form of a rectangular frame, thereby constituting a vacuum envelope. A phosphor screen is formed on the inner surface of the front substrate. A large number of electron emitting elements for use as sources of electron emission that excite the phosphors to luminescence are provided on the inner surface of the rear substrate.

In order to support an atmospheric load that acts on the front substrate and the rear substrate, a plurality of support members are arranged between the substrates. The potential on the rear substrate side is substantially equal to the earth potential, and an anode voltage is applied to the phosphor surface. Electron beams that are emitted from the electron emitting elements are applied to red, green, and blue phosphors that constitute the phosphor screen, whereupon the phosphors are caused to glow, thereby displaying an image.

According to the FED or SED constructed in this manner, the thickness of the display apparatus can be reduced to several millimeters. Therefore, it can be made lighter in weight and thinner than a CRT that is used as a display of an existing TV set or computer.

In the FED or SED described above, a high vacuum must be formed in the envelope. Also in the PDP, the envelope must be evacuated once before it is filled with discharge gas.

As means for evacuating the envelope, there is a method in which the front substrate, rear substrate, and sidewall that constitute the envelope are heated and joined together by means of a suitable sealing material in the atmosphere. After the envelope is then exhausted through an exhaust pipe that is attached to the front substrate or the rear substrate, in this method, the exhaust pipe is vacuum-sealed. In evacuating the flat envelope through the exhaust pipe, however, the exhaust speed is very low, and the attainable degree of vacuum is low. Thus, the mass-productivity and properties are not reliable.

A method to solve this problem is described in Jpn. Pat. Appln. KOKAI Publication No. 2000-229825, for example. According to this method, the front substrate and the rear substrate that constitute the envelope are finally assembled in a vacuum chamber.

In this method, the front substrate and the rear substrate that are brought into the vacuum chamber are first fully heated in advance. This is done in order to reduce the gas discharge through the inner wall of the envelope that constitutes the principal cause of lowering of the degree of vacuum of the envelope. When the front substrate and the rear substrate are then cooled so that the degree of vacuum in the vacuum is fully enhanced, a getter film for improving and maintaining the degree of vacuum is formed on the phosphor screen. Thereafter, the front substrate and the rear substrate are heated again to a temperature high enough to melt the sealing material. The front substrate and the rear substrate are combined together in a predetermined position as they are cooled so that the sealing material is solidified.

For the vacuum envelope constructed by this method, a sealing process doubles as a vacuum encapsulation process. Besides, a lot of time that is required for exhausting can be obviated, and a very satisfactory degree of vacuum can be obtained. Preferably, in this method, moreover, a low-melting-point metallic material that is suited for batch sealing and encapsulation should be used as the sealing material. Since the low-melting-point metallic material has low viscosity when it is melted, however, it may possibly flow out of a desired sealing region during the sealing operation.

Flat display apparatuses such as the SED, in particular, require a high degree of vacuum, and inevitably become defective if the sealing layer allows a single leakage. In order to improve the yield of manufacture or mass production of large-sized image display apparatuses, therefore, the airtightness of the sealing portion must be enhanced to ensure higher reliability.

BRIEF SUMMARY OF THE INVENTION

This invention has been made in consideration of these circumstances, and its object is to provide an image display apparatus, of which a sealing portion has airtightness high enough to ensure improved reliability, and a method of manufacturing the same.

In order to solve the above problem, an image display apparatus according to an aspect of the present invention comprises an envelope which has a rear substrate and a front substrate opposed to the rear substrate, and a plurality of image display elements arranged inside the envelope, the front substrate and the rear substrate individually having peripheral edge portions sealed together with a sealing layer therebetween. At least one of the front substrate and the rear substrate has a diffusion layer formed on an interface with the sealing layer and containing a component of the sealing layer.

Further, a method of manufacturing an image display apparatus according to another aspect of the present invention is a manufacturing method for an image display apparatus which comprises an envelope having a rear substrate and a front substrate opposed to the rear substrate and a plurality of image display elements arranged inside the envelope. The method comprises forming a ground layer along a sealing surface between the rear substrate and the front substrate, firing the ground layer at a given temperature to diffuse a component of the ground layer on the sealing surface side, thereby forming a diffusion layer, forming a metallic sealing material layer on the fired ground layer, and heating the rear substrate and the front substrate in a vacuum atmosphere to melt the metallic sealing material layer and the ground layer, thereby sealing the rear substrate and the front substrate to each other.

According to the image display apparatus and the method of manufacturing the same constructed in this manner, some of materials contained in the sealing layer diffuse into a region near the interface of the front substrate and/or the rear substrate in contact with the sealing layer, thereby forming the diffusion layer. This diffusion layer greatly improves the adhesion between the sealing layer and the substrates, so that a highly airtight sealing structure can be obtained.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment in which an image display apparatus according to this invention is applied to an FED will now be described in detail with reference to the drawings.

Figure 1:
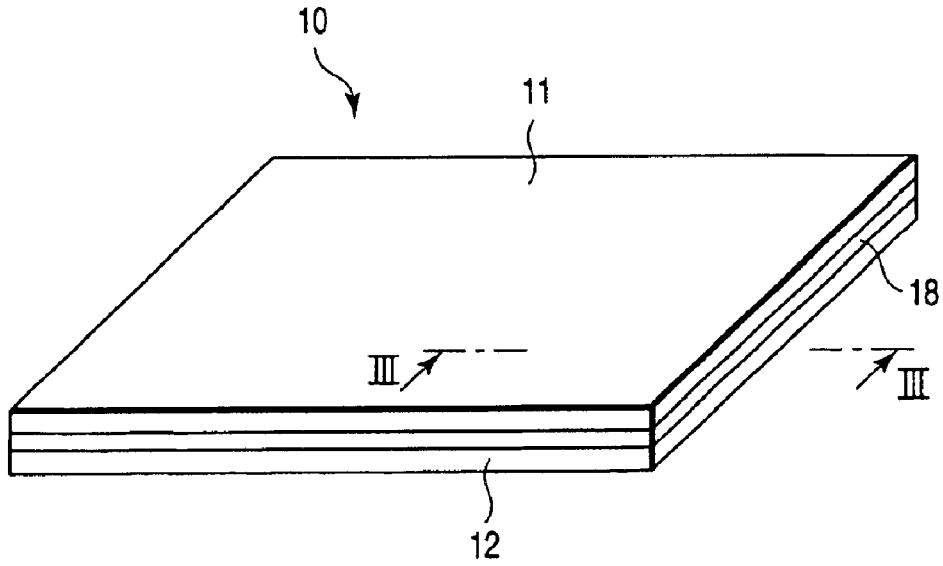
FIG. 1 is a perspective view showing an FED according to an embodiment of this invention.
Figure 2:
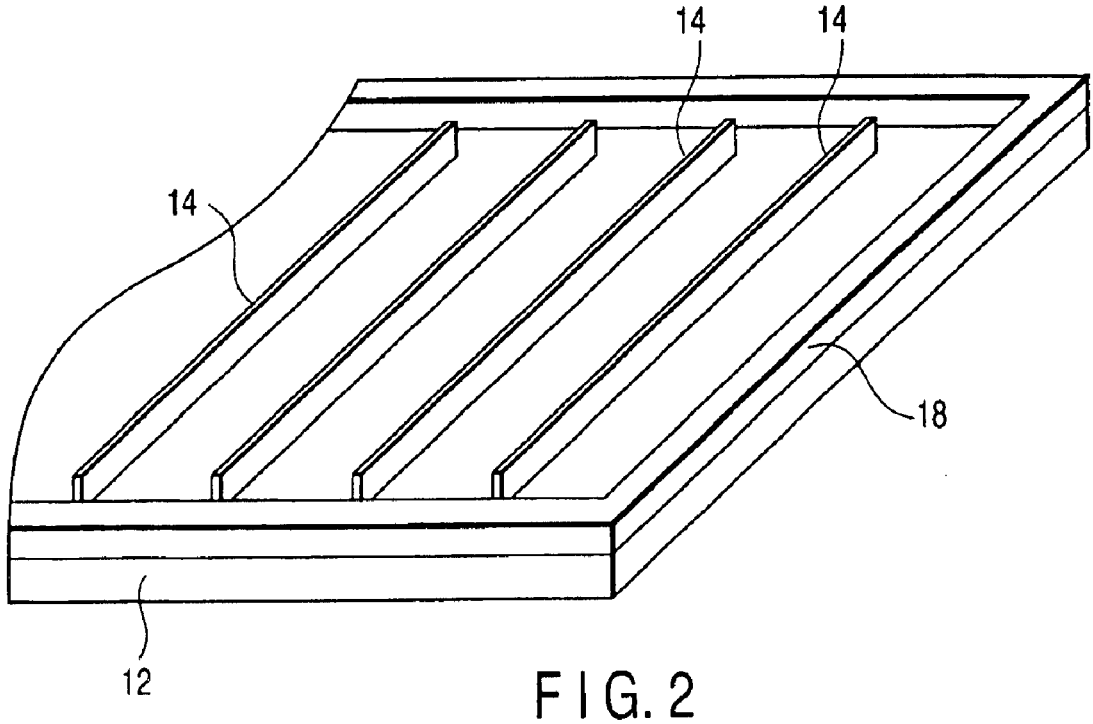
FIG. 2 is a perspective view showing the FED with its front substrate off.
Figure 3:
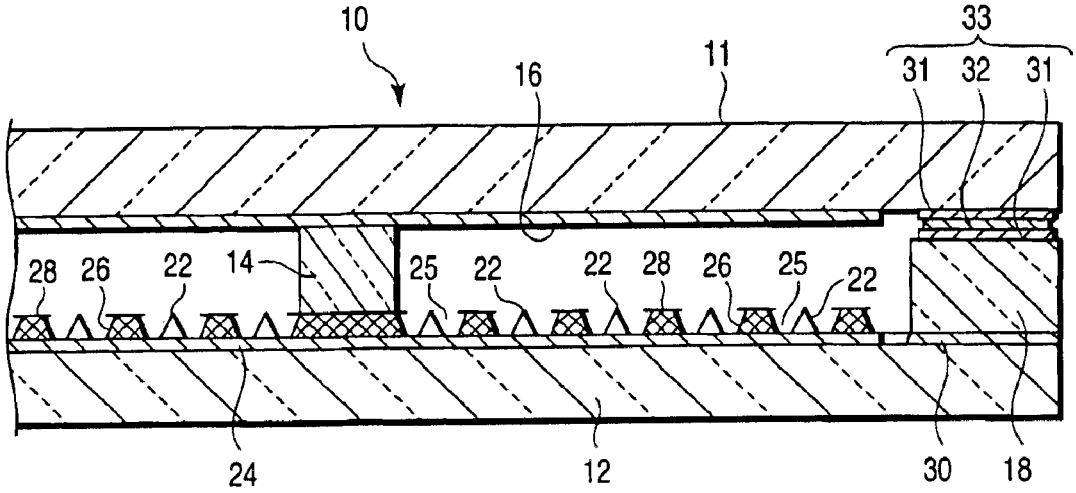
FIG. 3 is a sectional view taken along line III—III of FIG. 1.

As shown in FIGS. 1 to 3, this FED comprises a front substrate 11 and a rear substrate 12 for use as insulating substrates, which are formed of rectangular glass plates, individually. These substrates 11 and 12 are opposed to each other with a gap of about 1.5 to 3.0 mm between them. The front substrate 11 and the rear substrate 12 have their respective peripheral edge portions joined together by means of a sidewall 18 in the form of a rectangular frame. They constitute a flat, rectangular vacuum envelope 10, the inside of which is kept at a vacuum.

The vacuum envelope 10 has therein a plurality of plate-shaped support members 14, which support an atmospheric load that acts on the rear substrate 12 and the front substrate 11. These support members 14 extend parallel to the short sides of the vacuum envelope 10 and are arranged at given spaces in the direction parallel to the long sides. The support members 14 are not limited to the plate shape, and columnar support members may be used instead.

Figure 4:
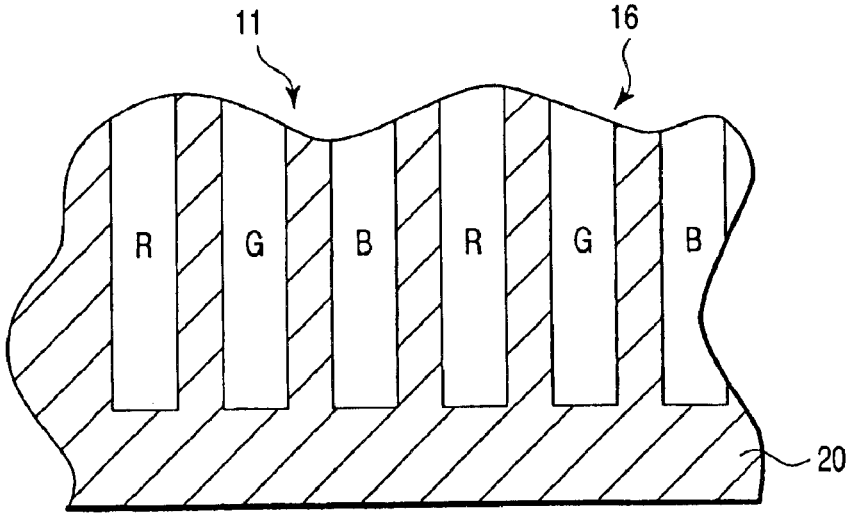
FIG. 4 is a plan view showing a phosphor screen of the FED.

As shown in FIG. 4, a phosphor screen 16 is formed on the inner surface of the front substrate 11. The phosphor screen 16 is formed by arranging phosphor layers R, G and B, in the form of a stripe each, and a striped black light-absorbing layer 20. The phosphor layers R, G and B glow in three colors, red, green, and blue, respectively. The light-absorbing layer 20 serves as a non-luminous portion that separates the phosphor layers. The phosphor layers R, G and B extend parallel to the short sides of the vacuum envelope 10 and are arranged at given spaces in the direction parallel to the long sides. Further, an aluminum layer (not shown) as a metal back is formed on the phosphor screen 16 by vapor deposition.

A large number of field-emission electron emitting elements 22 are arranged on the inner surface of the rear plate 12, as shown in FIG. 3. They individually emit electron beams to serve as electron emission sources that excite the phosphor layers R, G and B. These electron emitting elements 22 are arranged in a plurality of columns and in a plurality of rows corresponding to individual pixels.

More specifically, a conductive cathode layer 24 is formed on the inner surface of the rear substrate 12, and a silicon dioxide film 26 having a large number of cavities 25 is formed on this conductive cathode layer. Formed on the silicon dioxide film 26 is a gate electrode 28 that is formed of molybdenum, niobium, or the like. The cone-shaped electron emitting elements 22 of molybdenum or the like are formed individually in the cavities 25 over the inner surface of the rear substrate 12. Formed on the rear substrate 12, moreover, is a wiring matrix (not shown) or the like that is connected to the electron emitting elements 22.

In the FED constructed in this manner, a video signal is applied to the electron emitting elements 22 and the gate electrode 28. With the electron emitting elements 22 regarded as a reference, a gate voltage of +100 V is applied for maximum luminance. Further, +10 kV is applied to the phosphor screen 16. The electron beams that are emitted from the electron emitting elements 22 are modulated by means of the voltage of the gate electrode 28. An image is displayed as these electron beams excite the phosphor layers of the phosphor screen 16 to glow.

Since a high voltage is applied to the phosphor screen 16 in this manner, high-strain-point glass is used as plate glass for the front substrate 11, rear substrate 12, phosphor screen 16, sidewall 18, and support members 14. As mentioned later, a gap between the rear substrate 12 and the sidewall 18 is sealed with a low-melting-point glass 30 such as fritted glass, while a gap between the front substrate 11 and the sidewall 18 is sealed with a sealing layer 33, which is a fused combination of ground layers 31 that are formed individually on sealed surfaces and an indium layer 32 formed on the ground layers.

The following is a detailed description of a manufacturing method for the FED constructed in this manner.

First, the phosphor screen 16 is formed on the plate glass that forms the front substrate 11. In doing this, the plate glass as large as the front substrate 11 is prepared, and stripe patterns for the phosphor layers are formed on the plate glass. The plate glass having the phosphor stripe patterns and the plate glass for the front substrate are placed on a positioning tool. The positioning tool is set on an exposure stage, and the phosphor screen 16 is formed on the plate glass for the front substrate by exposure and development.

Subsequently, the electron emitting elements 22 are formed on the plate glass for the rear substrate. In this case, the matrix-shaped conductive cathode layer is formed on the plate glass, and the silicon dioxide film is formed on this conductive cathode layer by the thermal oxidation method, CVD method, or sputtering method.

Thereafter, a metal film of molybdenum or niobium for gate electrode formation is formed on the insulating film by the sputtering method or electron beam deposition method, for example. Then, a resist pattern corresponding in shape to the metal film to be formed is formed by lithography. The metal film is etched to form the gate electrode 28 by the wet etching method or dry etching method with use of the resist pattern as a mask.

Then, the insulating film is etched by the wet etching method or the dry etching method with use of the resist pattern and the gate electrode as masks. After the resist pattern is removed, a separation layer of aluminum or nickel, for example, is formed on the gate electrode 28 by electron beam deposition from a direction inclined at a given angle to the surface of the rear substrate. Thereafter, molybdenum for use as the material for cathode formation, for example, is deposed by the electron beam deposition method from a direction perpendicular to the surface of the rear substrate. By doing this, the electron emitting elements 22 are formed in the cavities 25, individually. Subsequently, the separation layer is removed together with the metal film formed thereon by the lift-off method.

Thereafter, the peripheral edge portion of the rear substrate 12, which is formed on the electron emitting elements 22, and the sidewall 18 in the form of a rectangular frame are sealed to each other by means of the low-melting-point glass 30 in the atmosphere.

Figure 5A:
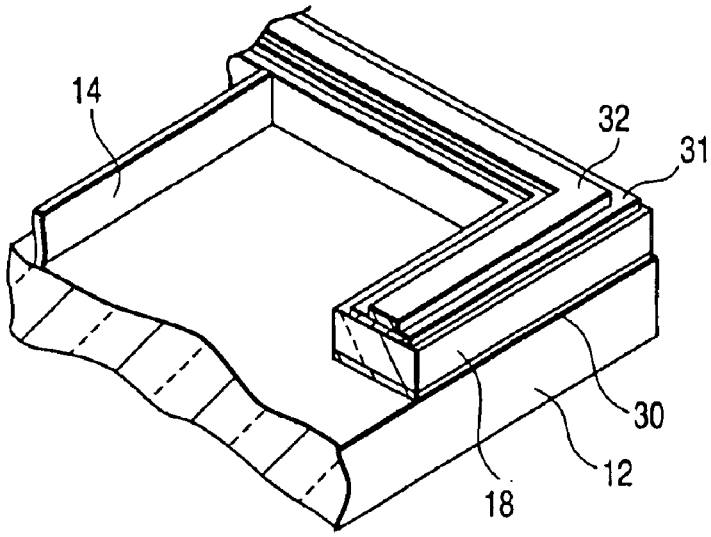
FIG. 5A is a perspective view showing a state in which a ground layer and an indium layer are formed on a sealing surface of a sealing surface of a sidewall that constitutes a vacuum envelope of the FED.
Figure 5B:
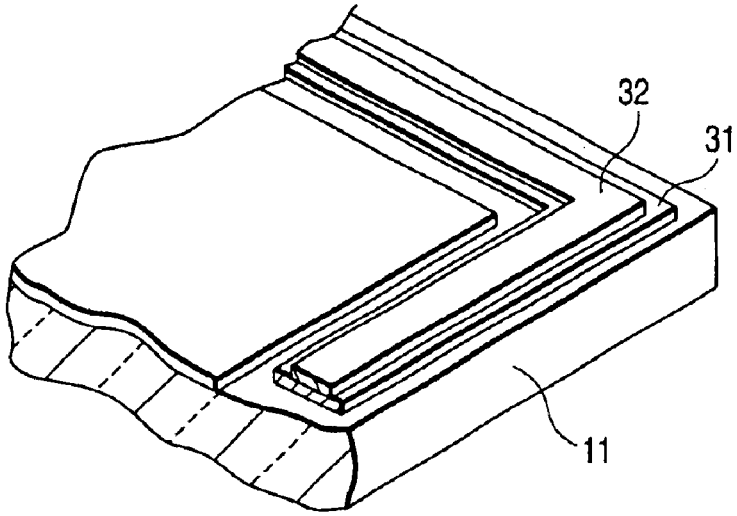
FIG. 5B is a perspective view showing a state in which a ground layer and an indium layer are formed on a sealing surface of the front substrate that constitutes the vacuum envelope of the FED.

Subsequently, the rear substrate 12 and the front substrate 11 are sealed to each other with the sidewall 18 between them. In this case, the individual ground layers 31 of a given width are first formed over the top surface of the sidewall 18 and the peripheral edge portion of the inner surface of the front substrate 11, which form the sealing surfaces, as shown in FIGS. 5A and 5B.

In the present embodiment, a silver paste is used for the ground layers 31. In forming the layers, the silver paste is applied to necessary spots by the screen printing method. After the applied silver paste is naturally dried, it is further dried at 150° C. for 20 minutes. Thereafter, the temperature is raised to about 580° C. to fire the silver paste, thereby forming the ground layers 31. By thus firing the silver paste at a temperature of about 400° C. or more to form the ground layers 31, the Ag component of the ground diffuses into the surface layers of the substrates and forms diffusion layers.

Subsequently, indium as a metallic sealing material is spread on each ground layer 31 and forms the indium layer 32 that covers the whole periphery of each ground layer.

Preferably, a low-melting-point material that has a melting point of about 350° C. or less and enjoys a good adhesion and bondability should be used as the metallic sealing material. Indium (In) that is used in the present embodiment has a melting point as low as 156.7° C., and besides, has outstanding features, such as a low vapor pressure, high malleability, high shock resistance, and cannot be rendered brittle even at low temperature. Depending on conditions, moreover, indium can be bonded directly to glass.

As the low-melting-point metallic material, furthermore, indium as a simple element may be replaced with silver oxide or an alloy of In doped with a simple element, such as silver, gold, copper, aluminum, zinc, or tin, or with a combination of these elements. For example, an In-97% Ag-3% eutectic alloy offers a lower melting point of 141° C. and enhanced mechanical strength.

Although the term "melting point" is used in the above description, some alloys that are formed of two or more kinds of metals each may not have one definite melting point. In general, liquid- and solid-phase linear temperatures are defined for these alloys. The former is a temperature at which an alloy starts to be partially solidified as the temperature is lowered from the value for the liquid state, while the latter is a temperature at which the alloy is wholly solidified. For convenience of description, according to the present embodiment, the term "melting point" is also used for the alloy of this type, and the solid-phase linear temperature is called the melting point.

On the other hand, the ground layers 31 are formed of a material that is highly wettable to and airtight against the metallic sealing material, that is, a material having high affinity to the metallic sealing material. A metal such as Ni, Co, Au, Cu or Al may be used in place of the silver paste.

Figure 6:
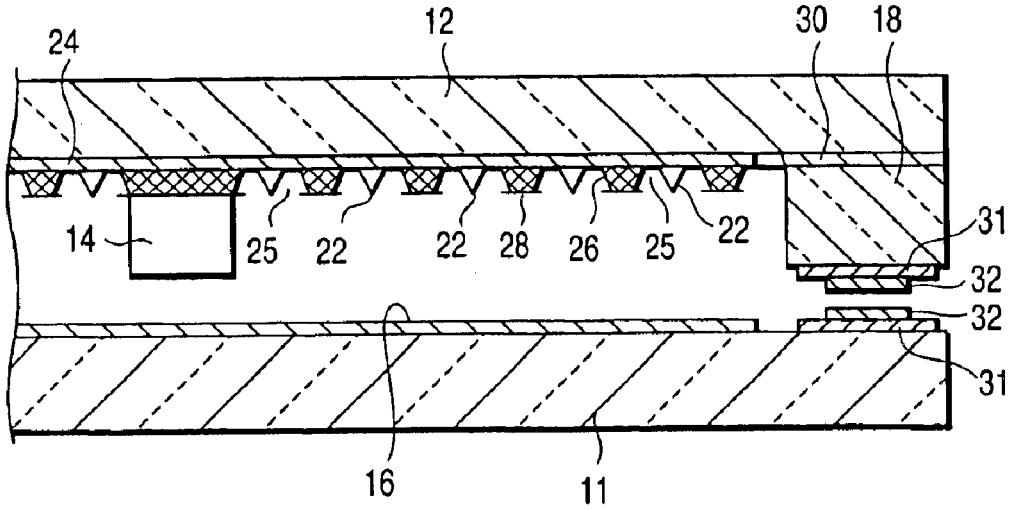
FIG. 6 is a sectional view showing a state in which a rear-side assembly, including the ground layer and the indium formed on the sealing portion, and the front substrate are opposed to each other.

Then, the front substrate 11, having the ground layer 31 and the indium layer 32 formed on its sealing surface, and a rear-side assembly, which includes the sidewall 18, sealed to the rear substrate 12, and the ground layer 31 and the indium layer 32 formed on the top surface of the sidewall, are held by means of a tool or the like in a manner such that their respective sealing surfaces face each other at a given distance from each other, as shown in FIG. 6. They are then put into a vacuum processor.

Figure 7:
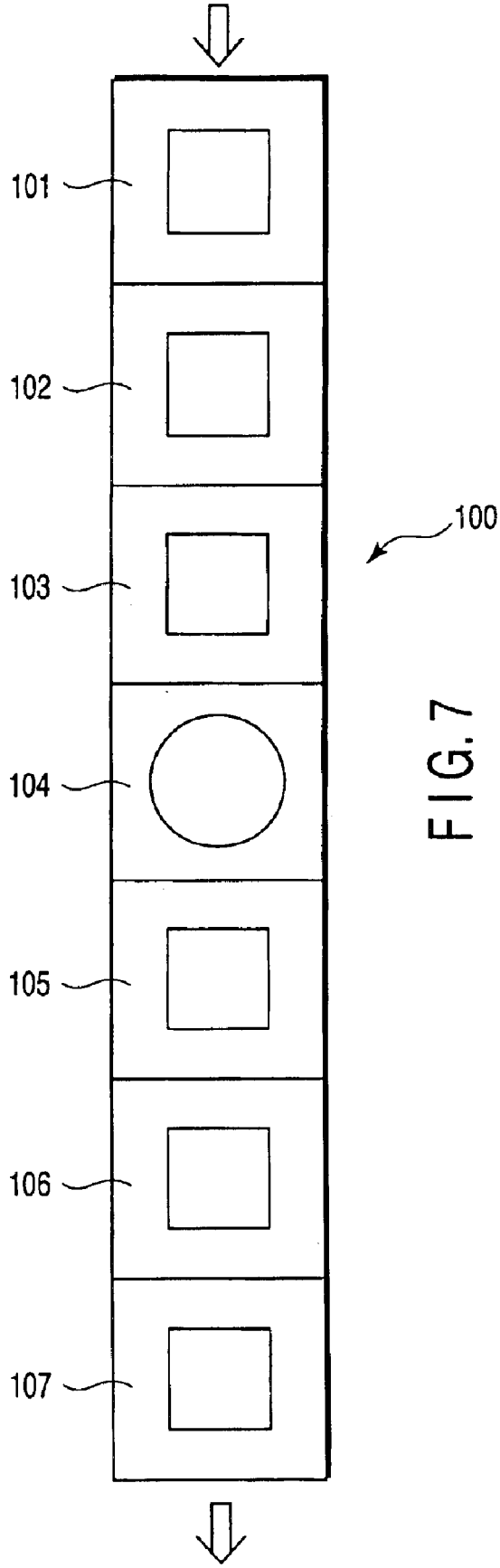
FIG. 7 is a diagram schematically showing a vacuum processor used in the manufacture of the FED.
Figure 8:
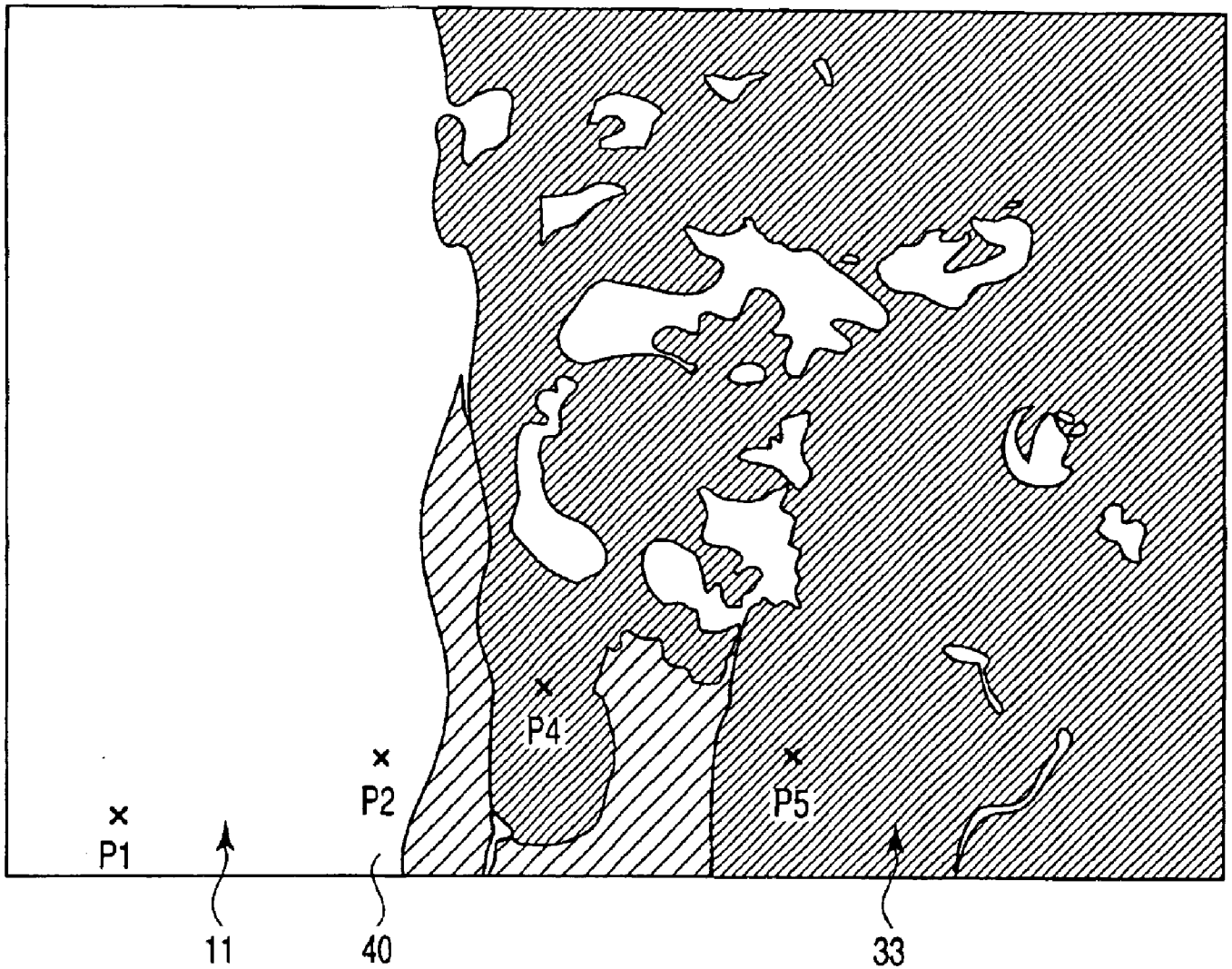
FIG. 8 is a diagram showing a TEM observation image of a region near a sealing layer interface of the FED obtained by the ion milling method.
Figure 9:
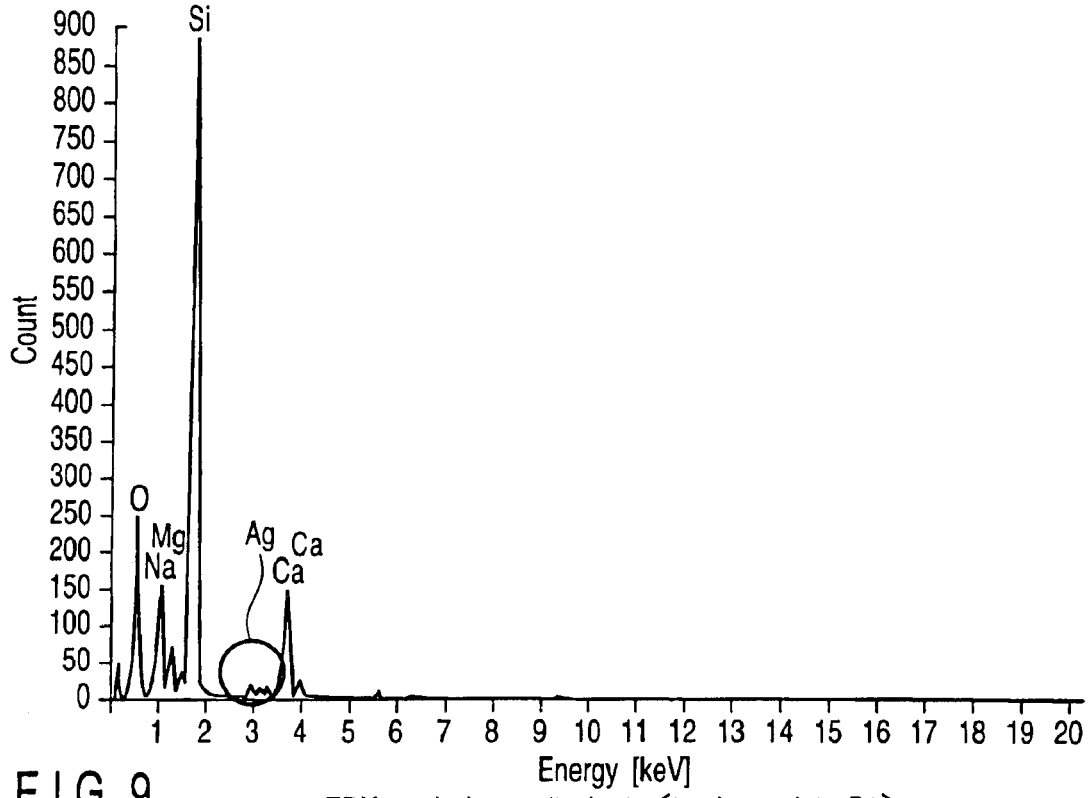
FIG. 9 is a diagram showing EDX analysis data on an analysis point P1 near the sealing layer interface in FIG. 8.
Figure 10:
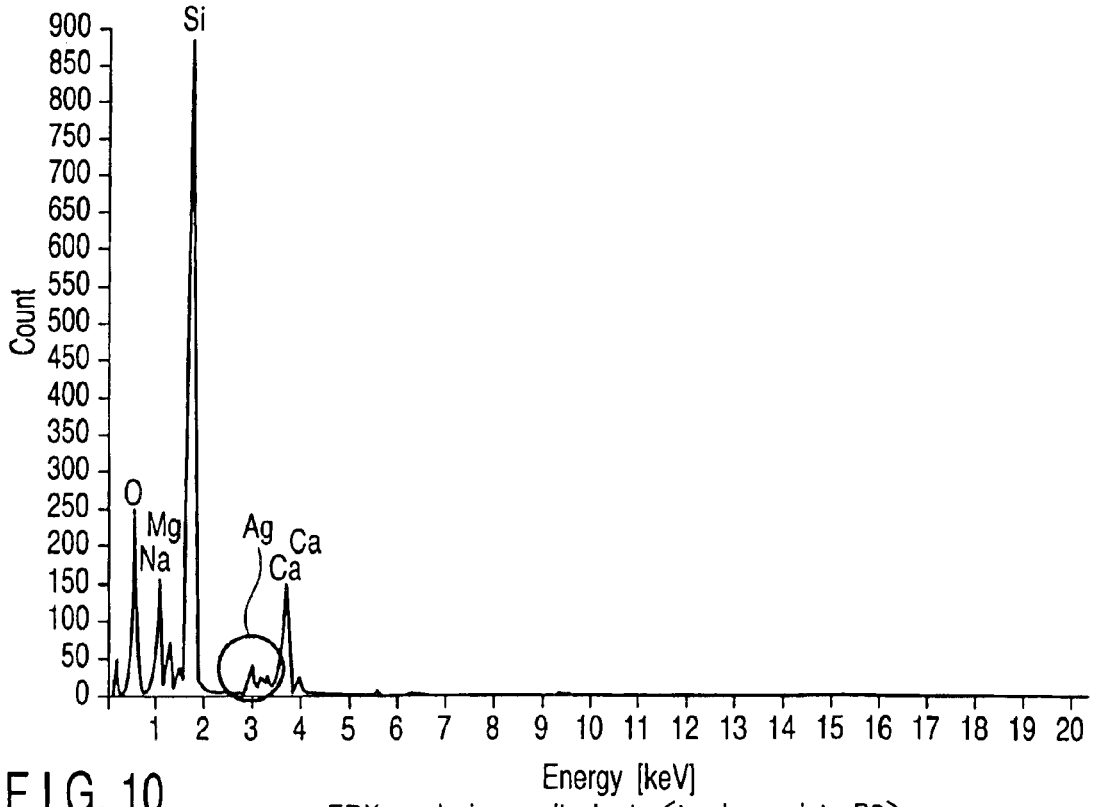
FIG. 10 is a diagram showing EDX analysis data on an analysis point P2 near the sealing layer interface.
Figure 11:
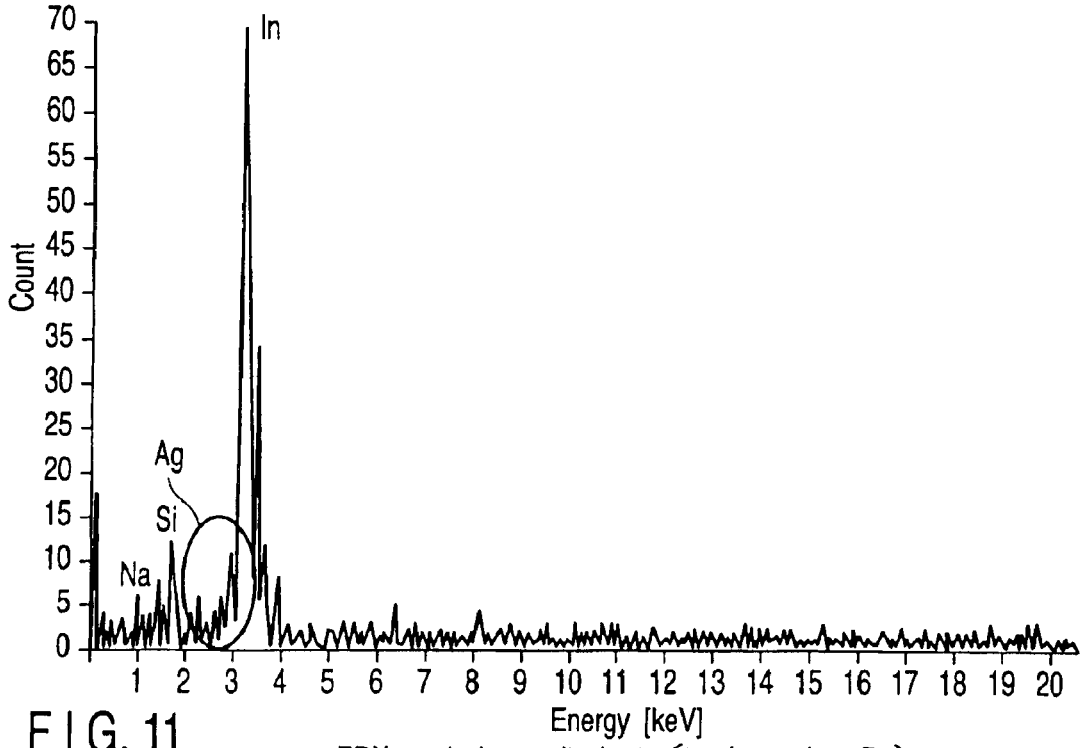
FIG. 11 is a diagram showing EDX analysis data on an analysis point P4 near the sealing layer interface.
Figure 12:
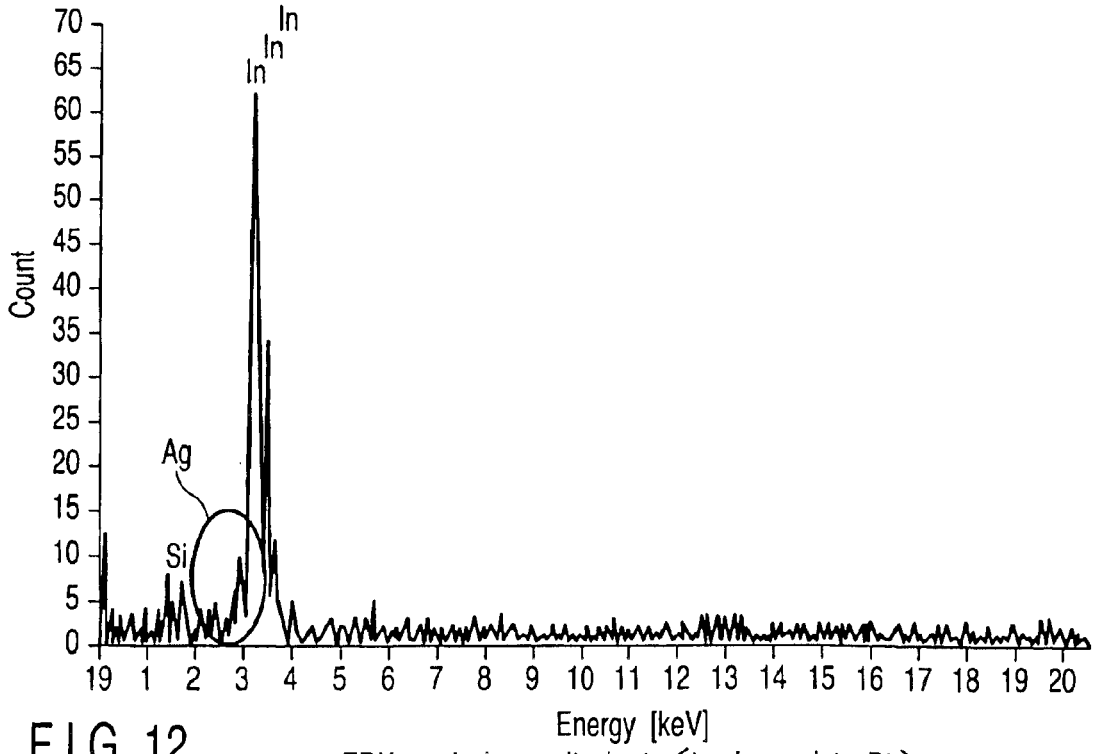
FIG. 12 is a diagram showing EDX analysis data on an analysis point P5 near the sealing layer interface.

As shown in FIG. 7, a vacuum processor 100 comprises a loading chamber 101, baking and electron-beam cleaning chamber 102, cooling chamber 103, vapor deposition chamber 104 for getter film, assembly chamber 105, cooling chamber 106, and unloading chamber 107. Each chamber is composed as a processing chamber capable of vacuum processing, and all the chambers are evacuated during the manufacture of the FED. Further, the adjacent processing chambers are connected to each other through gate valves or the like.

The rear-side assembly and the front substrate 11, which are opposed to each other with the given space between them, are put into the loading chamber 101. After a vacuum atmosphere is formed in the loading chamber 101, they are fed into the baking and electron-beam cleaning chamber 102. When a high degree of vacuum of about $10^{-5}$ Pa is attained, the rear-side assembly and the front substrate 11 are heated to a temperature of about 300° C. and baked, and gas adsorbed on the surfaces of the individual members is discharged thoroughly, in the baking and electron-beam cleaning chamber 102.

At this temperature, the indium layer (melting point: about 156° C.) 32 melts. Since the indium layer 32 is formed on the ground layer 31 that has high affinity, however, the indium can be held on the ground layer 31 without flowing. Thus, the indium can be prevented from flowing toward the electron emitting elements 22, outside the rear substrate 12, or toward the phosphor screen 16.

In the baking and electron-beam cleaning chamber 102, moreover, electron beams from an electron beam generator (not shown), which is attached to the baking and electron-beam cleaning chamber 102, are applied to the phosphor screen surface of the front substrate 11 and the electron emitting element surfaces of the rear substrate 12. These electron beams are deflected and scanned by a deflector that is attached to the outside of the electron beam generator. Thus, the phosphor screen surface and the whole electron emitting element surfaces can be cleaned with the electron beams.

After they are heated and cleaned with the electron beams, the rear-substrate-side assembly and the front substrate 11 are fed into the cooling chamber 103, and cooled to a temperature of about 100° C., for example. Subsequently, the rear-side assembly and the front substrate 11 are fed into the vapor deposition chamber 104, whereupon a Ba film as a getter film is formed on the outer surface of the phosphor screen by vapor deposition. The surface of the Ba film can be prevented from being contaminated by oxygen or carbon and be kept active.

Then, the rear-side assembly and the front substrate 11 are fed into the assembly chamber 105, whereupon they are heated to 200° C. so that the indium layer 32 is melted again into a liquid or softened. In this state, the front substrate 11 and the sidewall 18 are joined and pressurized under a given pressure, and the indium is then annealed and solidified. Thereupon, the front substrate 11 and the sidewall 18 are sealed together with the sealing layer in which the indium layer 32 and the ground layers 31 are fused together, whereby the vacuum envelope 10 is formed.

After the vacuum envelope 10 formed in this manner is cooled to normal temperature in the cooling chamber 106, it is taken out of the unloading chamber 107. The FED is completed by these processes.

According to the FED constructed in this manner and its manufacturing method, the front substrate 11 and the rear substrate 12 are sealed together in the vacuum atmosphere, whereby the gas adsorbed on the surfaces of the substrates can be discharged thoroughly by the combination of baking and electron-beam cleaning. Accordingly, a satisfactory gas adsorption effect can be obtained without entailing oxidation of the getter film. Thus, the obtained FED can maintain a high degree of vacuum.

Since indium is used as the sealing material, moreover, the sealing layer, unlike one that uses fritted glass, never foams in a vacuum, so that an FED panel with high airtightness and sealing strength can be obtained. Since the ground layer 31 is located under the indium layer 32, the indium can be prevented from flowing out and kept in a given position even if it is melted in a sealing process.

In forming the ground layers 31, furthermore, the ground material is heated to be fired at a given temperature. By doing this, Ag as the ground component can be diffused into the surface layers of the substrates, so that the bondability between the substrates and the sealing layer can be improved. Thus, a vacuum vessel with high airtightness can be obtained.

FIGS. 8 to 12 show a TEM observation image on the interface between the sealing layer and the front substrate 11, obtained by the ion milling method, and EDX-based element analysis data on analysis points P1, P2, P4 and P5. As seen from these drawings, a diffusion layer 40 that is diffused with silver is formed on the interface between the sealing layer and the front substrate 11. Thus, Ag, the component of the ground layers 31, exists in the diffusion layer 40 on the side of the front substrate 11. In this case, the Ag content of the diffusion layer 40 is less than 3%. The thickness of the diffusion layer 40 ranges from 0.01 to 50 $\mu$m.

Figure 13:
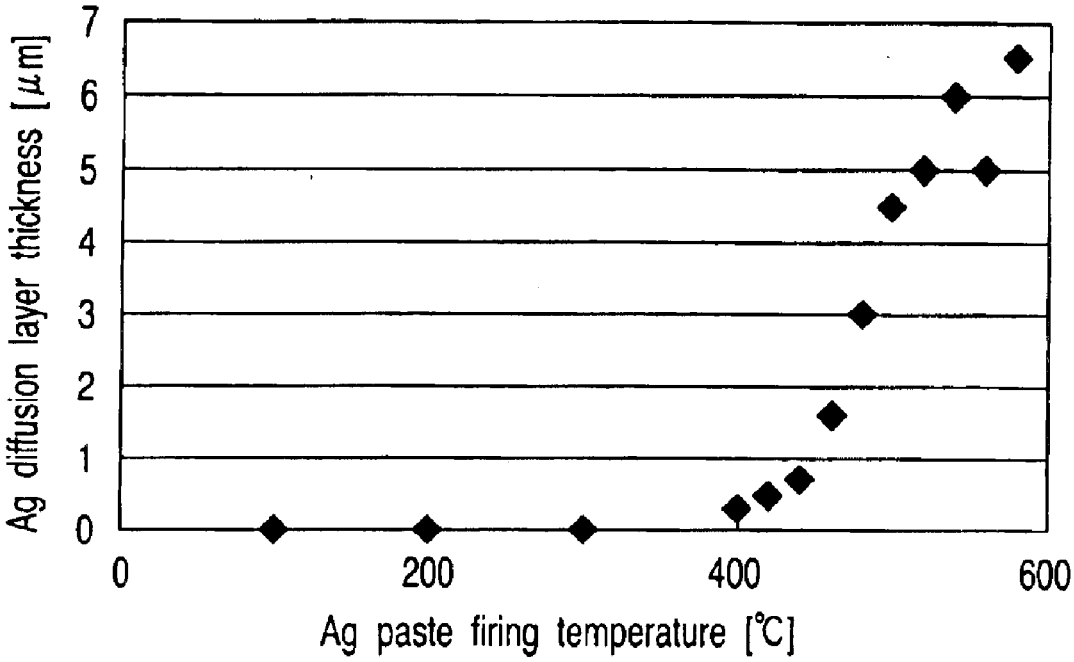
FIG. 13 is a diagram showing the relation between ground layer firing temperature and the thickness of a diffusion layer to be formed.

The higher the firing temperature for the ground layers 31, as shown in FIG. 13, the thicker the diffusion layer 40 formed in each of the surface layers of the front substrate 11 and the sidewall 18 is. Further, the diffusion layer can be thickened by lengthening the firing time. If the firing temperature for the ground layers 31 is low, in contrast with this, the thickness of the diffusion layer 40 is reduced. Preferably, therefore, the firing temperature should be set to 400° C. or more at minimum. Since the diffusion temperature varies depending on the element, moreover, the firing temperature for the formation of the diffusion layer should preferably be set on each occasion depending on the material used for the ground layers.

Thus, according to the FED constructed in this manner and its manufacturing method, some of the materials that are contained in the sealing layer are diffused by heat treatment into the front substrate and the sidewall that are in contact with the sealing layer. Likewise, some of the materials that are contained in the glass member are also diffused into the sealing layer. As this is done, the diffusion layer 40 that is diffused with the sealing layer material is formed in each of a front-substrate-side interface between the sealing layer and the front substrate and a sidewall-side interface between the sealing layer and the sidewall. This diffusion layer 40 greatly improves the adhesion between the sealing layer and the front substrate and between the sealing and the sidewall 18, so that a highly airtight sealing structure can be obtained. Thus, the envelope can be fabricated having a high degree of vacuum, and the FED with improved reliability and high performance can be obtained.

Figure 14:
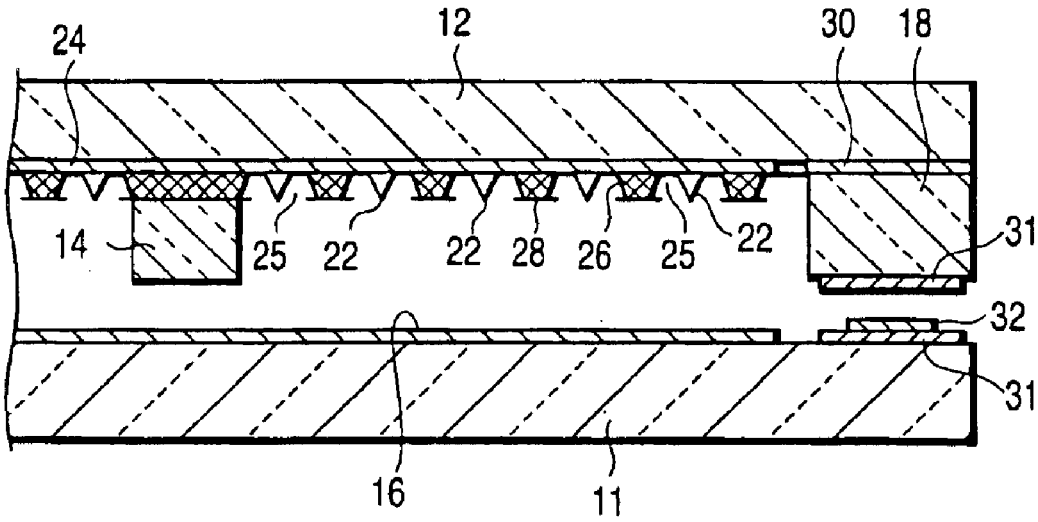
FIG. 14 is a sectional view showing an FED according to another embodiment of this invention.

In the embodiment described above, the respective sealing surfaces of the front substrate 11 and the sidewall 18 are sealed together in a manner such that the ground layer 31 and the indium layer 32 are formed on each of them. Alternatively, however, the indium layer 32 may be formed only on one of the sealing surfaces. As shown in FIG. 14, for example, the front substrate 11 and the sidewall 18 may be sealed in a manner such that the ground layer 31 and the indium layer 32 are formed only on the sealing surface of the front substrate 11 and that only the ground layer 31 is formed on the sealing surface of the sidewall 18.

This invention is not limited to the embodiments described above, and various modifications may be effected therein without departing from the scope of the invention.

For example, the rear substrate and the sidewall may be sealed together with a sealing layer that is formed by fusing together a ground layer 31 and an indium layer 32 that resemble the ones according to the foregoing embodiments. Further, the peripheral edge portion of the front substrate or the rear substrate may be bent so that these substrates can be joined directly to each other without any sidewall between them. Further, the indium layer is formed so that its width is smaller than that of the ground layer throughout the perimeter. If at least a part of the ground layer is formed having a width smaller than the width of the ground layer, however, indium can be prevented from flowing.

According to the foregoing embodiments, moreover, the field-emission electron emitting elements are used as the electron emitting elements. Alternatively, however, they may be replaced with electron emitting elements of any other type, such as pn-type cold cathode elements or surface-conduction electron emitting elements. Further, this invention is also applicable to any other image display apparatuses, such as a plasma display panel (PDP), electroluminescence (EL), etc.

What is claimed is:

1. An image display apparatus comprising:

an envelope which has a rear substrate and a front substrate opposed to the rear substrate and a plurality of image display elements arranged inside the envelope, the front substrate and the rear substrate individually having peripheral edge portions sealed together with a sealing layer therebetween, at least one of the front substrate and the rear substrate having a diffusion layer formed on an interface with the sealing layer and containing a component of the sealing layer.

2. An image display apparatus according to claim 1, wherein the sealing layer contains Ag.

3. An image display apparatus according to claim 2, wherein the diffusion layer has an Ag content of 3% or less.

4. An image display apparatus according to claim 1, wherein the sealing layer mainly contains indium or an alloy containing indium.

5. An image display apparatus according to claim 4, wherein the alloy containing In contains Sn, Ag, Ni, Al or Ga.

6. An image display apparatus according to claim 1, wherein the diffusion layer has a thickness of 0.01 to 50 $\mu$m.

7. An image display apparatus according to claim 1, wherein the sealing layer is formed of a fused combination of a ground layer and a metallic sealing material layer of a different type from the ground layer, located on the ground layer.

8. An image display apparatus according to claim 7, wherein the ground layer contains Ag, Ni, Co, Au, Cu or Al.

9. An image display apparatus comprising:

an envelope which has a rear substrate and a front substrate opposed to the rear substrate, the front substrate and the rear substrate individually having peripheral edge portions sealed together with a sealing layer therebetween;

a phosphor screen formed on the inner surface of the front substrate; and an electron emission source which is located on the rear substrate and emits an electron beam toward the phosphor screen, thereby causing the phosphor screen to glow, at least one of the front substrate and the rear substrate having a diffusion layer formed on an interface with the sealing layer and containing a component of the sealing layer.

10. A method of manufacturing an image display apparatus, which comprises an envelope having a rear substrate and a front substrate opposed to the rear substrate, and a plurality of image display elements arranged inside the envelope, the method comprising:

forming a ground layer along a sealing surface between the rear substrate and the front substrate;

firing the ground layer at a given temperature to diffuse a component of the ground layer on the sealing surface side, thereby forming a diffusion layer;

forming a metallic sealing material layer on the fired ground layer; and heating the rear substrate and the front substrate in a vacuum atmosphere to melt the metallic sealing material layer and the ground layer, thereby sealing the rear substrate and the front substrate to each other.

11. A method of manufacturing an image display apparatus according to claim 10, wherein the ground layer is formed of a metal paste containing Ag, Ni, Co, Au, Cu or Al.

12. A method of manufacturing an image display apparatus according to claim 10, wherein the ground layer is fired at a temperature of 400° C. or more.

13. A method of manufacturing an image display apparatus according to claim 10, wherein the metallic sealing material layer is formed of a low-melting-point metallic material having a melting point of 350° C. or less.

14. A method of manufacturing an image display apparatus according to claim 10, wherein the low-melting-point metallic material is indium or an alloy containing indium.

* * * * *